US006729487B1

(12) United States Patent
Dischler

(10) Patent No.: US 6,729,487 B1
(45) Date of Patent: May 4, 2004

(54) CONVERTIBLE CHILD-RESISTANT CLOSURE WITH INVERTIBLE BI-STABLE SPRING ELEMENT

(76) Inventor: Louis Dischler, 252 W. Park Dr. Duncan Park, Spartanburg, SC (US) 29306-5013

( * ) Notice: Subject to any disclaimer, the term of this patent is extended or adjusted under 35 U.S.C. 154(b) by 175 days.

(21) Appl. No.: 09/630,974

(22) Filed: Aug. 2, 2000

(51) Int. Cl.[7] ..... B65D 55/02
(52) U.S. Cl. ..... 215/220; 215/217; 215/204
(58) Field of Search ..... 215/217, 218, 215/219, 220, 222, 230, 231, 257, 354, 295, 296, 301, 298, 305, 204; 220/DIG. 19, 281; 217/110, 98

(56) References Cited

U.S. PATENT DOCUMENTS 2,772,018 A * 11/1956 Weiss ..... 220/231
3,244,308 A * 4/1966 Esposito, Jr.
3,685,676 A * 8/1972 Gach et al.
3,734,331 A * 5/1973 DeFelice
3,896,959 A * 7/1975 Roy
3,982,649 A * 9/1976 Wanderer ..... 217/110 X
4,346,809 A * 8/1982 Kusz
4,383,619 A * 5/1983 Mumford et al.
4,423,824 A * 1/1984 Varndell ..... 220/281
4,729,487 A * 3/1988 Wright
4,877,143 A * 10/1989 Travisano
5,474,194 A * 12/1995 Heilman et al.
5,819,968 A * 10/1998 Jones

* cited by examiner

*Primary Examiner*—Robin Hylton

(57) ABSTRACT

A bi-modal closure for a container opening is provided. The closure has a first mode intended for adult use, wherein the closure is readily opened, and a second child-resistant mode, wherein the closure is more difficult to open, especially by children. The conversion between modes is accomplished by use of a bi-stable element located in the closure.

39 Claims, 6 Drawing Sheets

FIG. 3
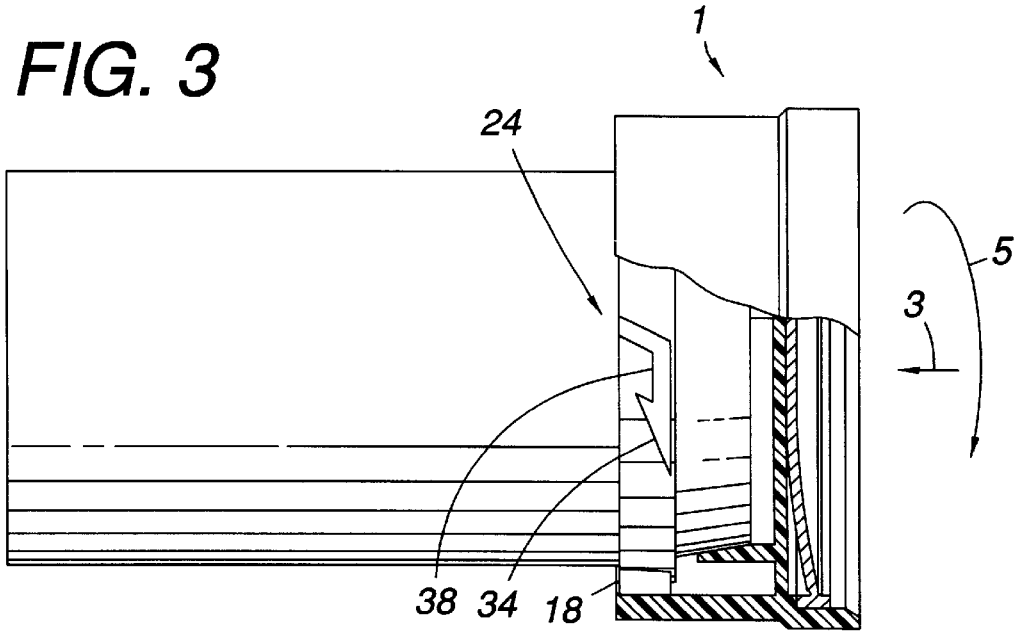
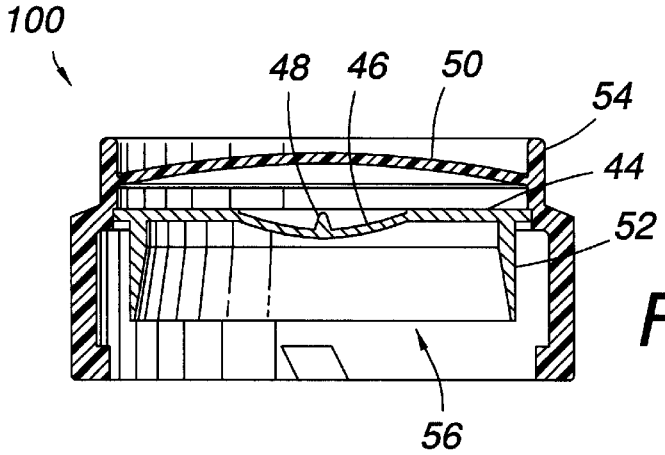
FIG. 5
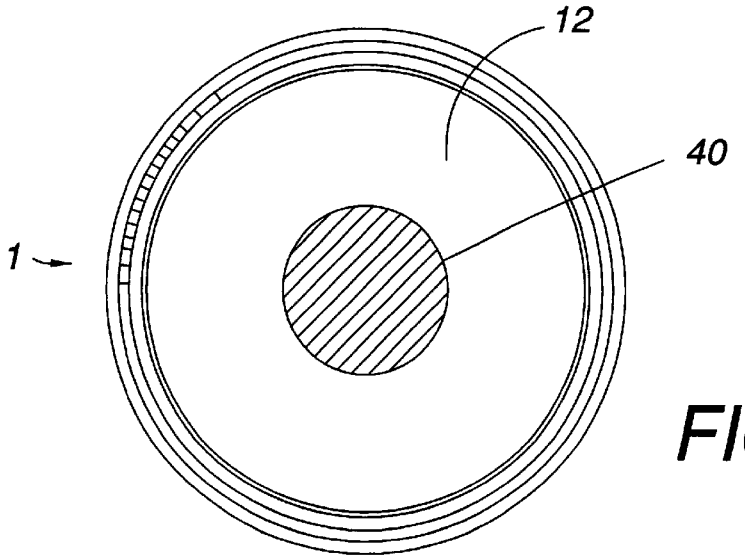
FIG. 4

FIG. 11A
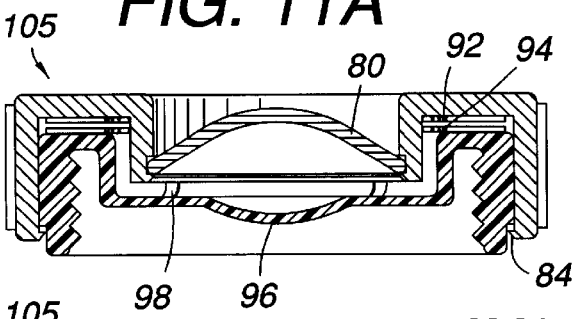
FIG. 11B
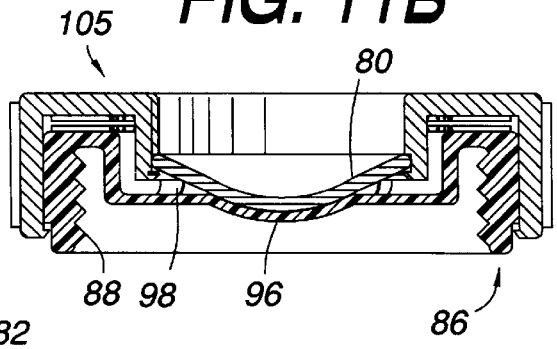
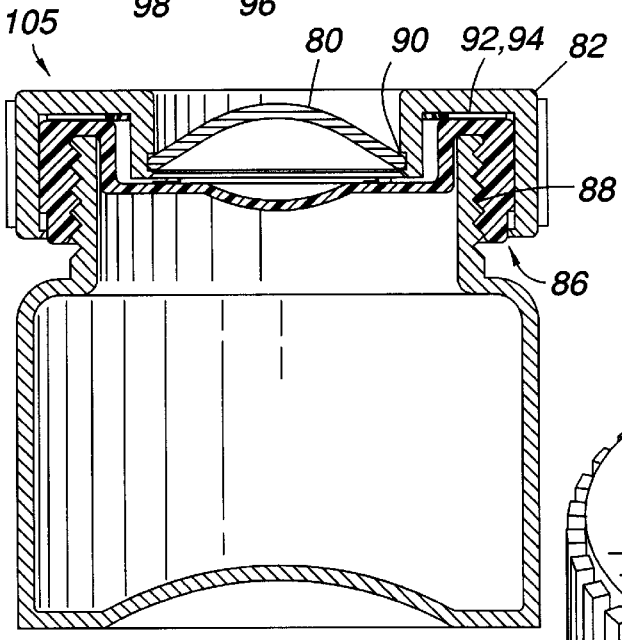
FIG. 12A
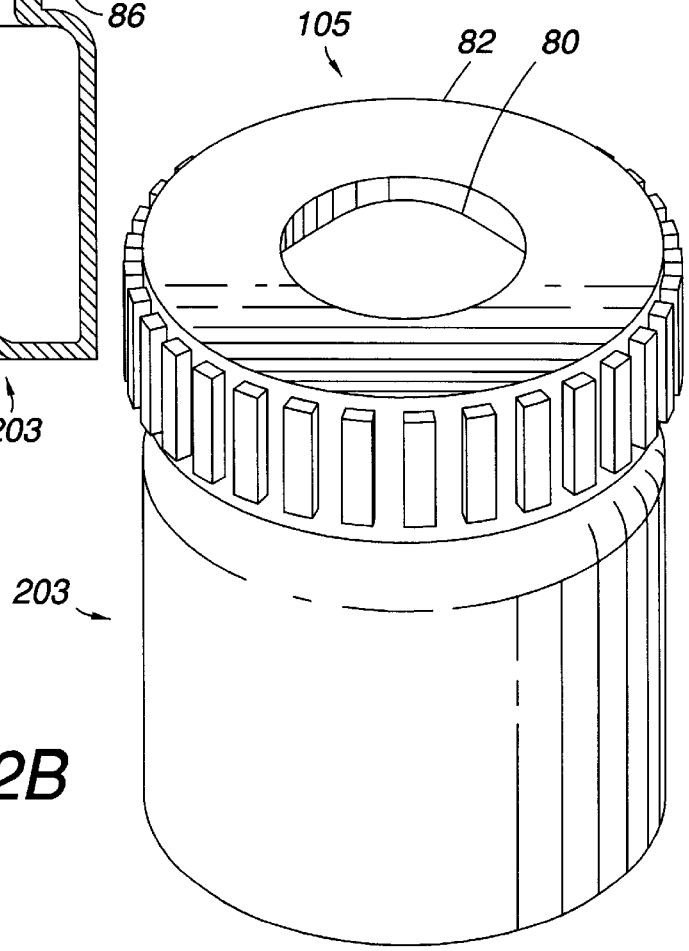
FIG. 12B

FIG. 13A
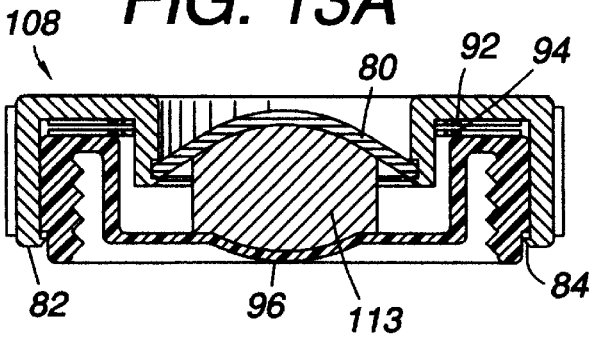
FIG. 13B
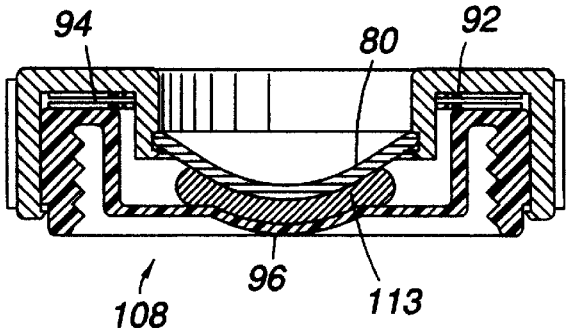
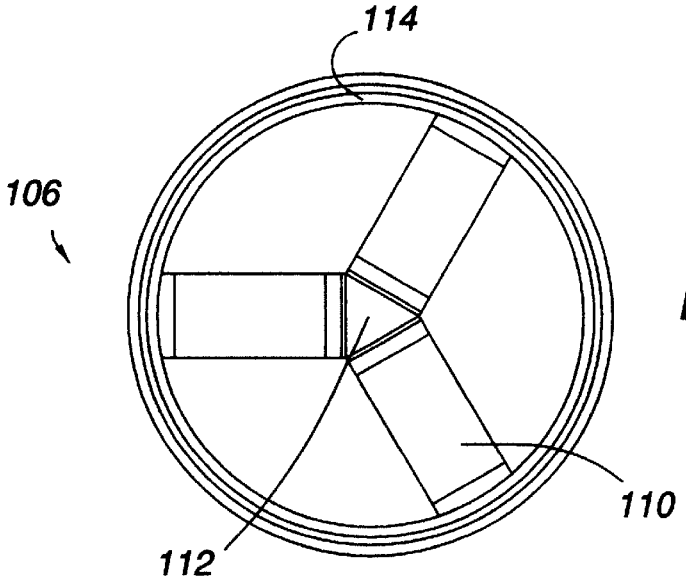
FIG. 14
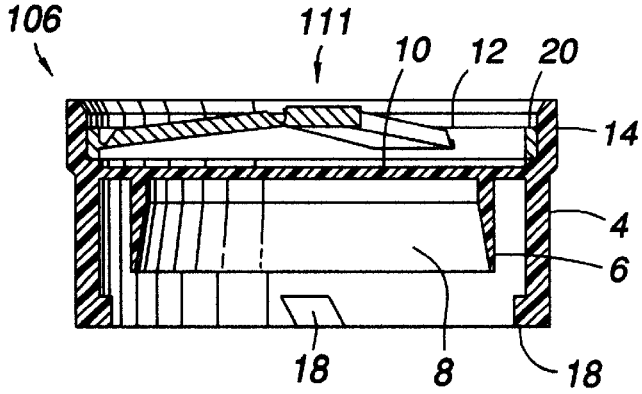
FIG. 15

CONVERTIBLE CHILD-RESISTANT CLOSURE WITH INVERTIBLE BI-STABLE SPRING ELEMENT

FIELD OF THE INVENTION

The present invention relates to closure members for containers, bottles, and the like, and more particularly, to child-resistant push-and-turn closure members which are adapted for use on dispensing containers for potentially hazardous materials, such as pharmaceutical agents.

SUMMARY OF THE INVENTION

The present invention provides for the bi-modal operation of a closure for a container opening. The closure has a first mode intended for adult use, wherein the closure is readily opened, and a second child-resistant mode, wherein the closure is more difficult to open, especially by children. When engaged to an opening, at least a portion of the closure (a deflecting member) has a distal relationship to the opening wherein the closure is substantially non-removable from the opening, and a proximal relationship to the opening wherein the closure may be easily removed from the opening. In the first mode, the movement between the distal and the proximal relationships requires little or no downward force; while in the second mode, the force require to effect the movement is greatly increased (when the force required to move between the distal and proximal relationships in the first mode is non-zero, the force required in the second mode should be at least 25% greater than that required in the first mode, preferably 50% greater, and most preferably at least twice that of the first mode). The conversion between modes is accomplished by use of a bi-stable spring located in the closure, preferably on the top surface of the closure. The bi-stable spring is preferably an invertible disk, and in the first mode presents a convex surface to the user. Depressing this surface with sufficient force results in the inversion of the disk into a stable second mode wherein the disk is concave, and wherein the disk serves to directly or indirectly urge the closure (or part of the closure) into the distal relationship with the opening. The geometrical state of the disk serves as a visual and tactile cue as to the instant mode of the closure. Conversion may typically be accomplished with finger pressure alone, and without the need to disengage the closure from the bottle. The details of the internal structure of the closure may be altered to allow finger pressure to return the closure to the first mode (by accessing the back side of the closure), or the conversion to the second mode from the first mode may be made irreversible by preventing access to the bi-stable spring element from the back side of the closure.

It is an object of the present invention, therefore, to provide a container closure convertible from a first adult-use mode to a second child-resistant mode.

The closure has a bi-stable element in its upper surface with a first substantially convex stable orientation and a second substantially concave stable orientation. The first stable orientation has a first associated spring rate of the deflecting member, and the second stable orientation has a second associated spring rate of the deflecting member, wherein the second spring rate is greater than the first spring rate, and wherein the bi-stable element may be converted from the first to the second stable orientations by finger pressure.

A further object of the invention is to provide an intuitively natural means for converting the container closure from the first mode to the second mode.

Yet another object of one embodiment of the invention is to provide a reversibly convertible container closure, wherein the closure may be converted from an adult-use mode to a child-resistant mode and back again.

Yet another object of one embodiment of the invention is to provide an irreversibly convertible container closure.

Yet another object of one embodiment of the invention is to provide a bi-modal container closure that can be converted from an adult use mode to a child-resistant mode while closed.

Yet another object of one embodiment of the invention is to provide a container system selectable between adult and child-resistant modes, for storage of potentially hazardous materials, especially pharmaceutical agents.

And yet another object of the invention is to provide a convertible container closure having a tactile and/or visual indication of operational status.

BRIEF DESCRIPTION OF THE DRAWINGS

The above as well as other objects of the invention will become more apparent from the following detailed description of the preferred embodiments of the invention, when taken together with the accompanying drawings in which:

FIG. 3 is a partial cross-sectional view of the push-and-turn closure as shown in FIG. 2, showing one of a plurality of bayonet teeth.

FIG. 4 is a view of the push-and-turn closure as shown in FIG. 3, in the direction indicated by arrow 3.

FIG. 5 is a cross-sectional view of a push-and-turn closure according to one embodiment of the invention, wherein the closure is in the first (adult) mode.

FIG. 11A is a cross-sectional view of a push-and-turn closure, according to one embodiment of the invention, with the closure in the first mode.

FIG. 11B is a cross-sectional view of a push-and-turn closure, according to one embodiment of the invention, with the closure in the second mode.

FIG. 12A is a cross-sectional view of a push-and-turn closure engaged to a container, according to one embodiment of the invention, with the closure in the first mode.

FIG. 12B is a perspective view of a push-and-turn closure engaged to a container of FIG. 12A.

FIG. 13A is a cross-sectional view of a push-and-turn closure, according to one embodiment of the invention, with the closure in the first mode.

FIG. 13B is a cross-sectional view of a push-and-turn closure, according to one embodiment of the invention, with the closure in the second mode.

FIG. 14 is a top view of a push-and-turn closure in the first mode, according to one embodiment of the invention, with a spoked bi-stable element.

FIG. 15 is a cross-sectional view of a push-and-turn closure in the first mode, according to one embodiment of the invention, with a spoked bi-stable element.

DESCRIPTION OF THE INVENTION

Figure 1A:
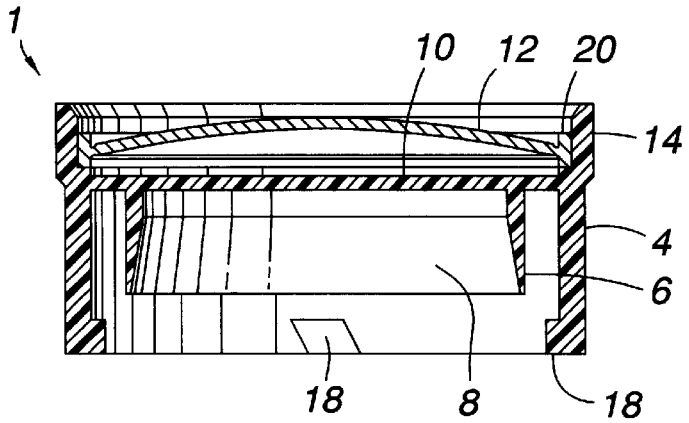
FIG. 1A is a cross-sectional view of a push-and-turn closure according to one embodiment of the invention, wherein the closure is in the first (adult-use) mode.
Figure 1B:
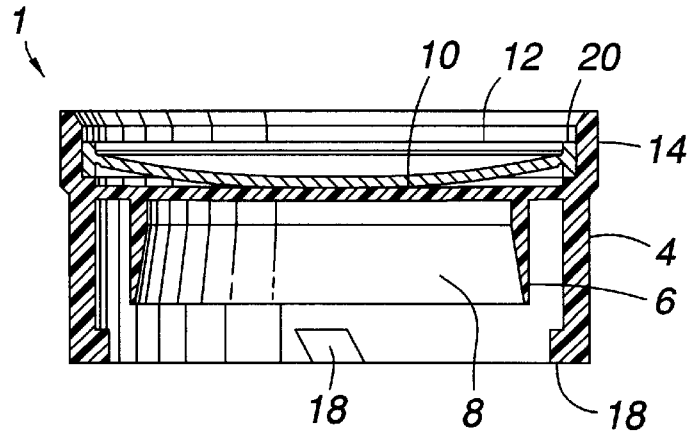
FIG. 1B is a cross-sectional view of a push-and-turn closure according to one embodiment of the invention, wherein the closure is in the second (child-resistant) mode.

Referring to FIGS. 1A and 1B, in accordance with one embodiment of the invention, the convertible closure, generally indicated by numeral 1, comprises lower ring 4 carrying projecting internal tabs 18. The lower ring 4 is continuous with the upper ring 14, which supports the curved disk 12 by pressure or adhesive contact with the annular disk ring 20. The closure may comprise any polymeric or elastomeric material used to manufacture closures, and the curved disk 12 may even comprise a metallic material, with adjustments made to the thickness of the disk to compensate for the varying differences in modulus of these materials. The closure taper 6 having taper face 8, is supported by top 10, which is integral with the lower ring 4. The combination of closure taper 6 and top 10 is somewhat compliant, and deflects vertically along the vertical axis of the closure relative to the upper ring 14 and the rest of the closure 1, when downward vertical force is applied to the upper ring 14. In FIG. 1A, the closure 1 is in the first (adult-use) mode, while in FIG. 1B, the closure is in the second (child-resistant) mode. In the second mode, the bi-stable curved disk 12 is inverted into the second stable position, and loads the top 10 by pressure contact, thereby increasing the effective spring rate of the top 10 and increasing its resistance to vertical deflection when downward pressure is applied to upper ring 14. It is preferred that the effective spring rate in the second mode be at least one pound per inch, and more preferably at least five pounds per inch.

Figure 2:
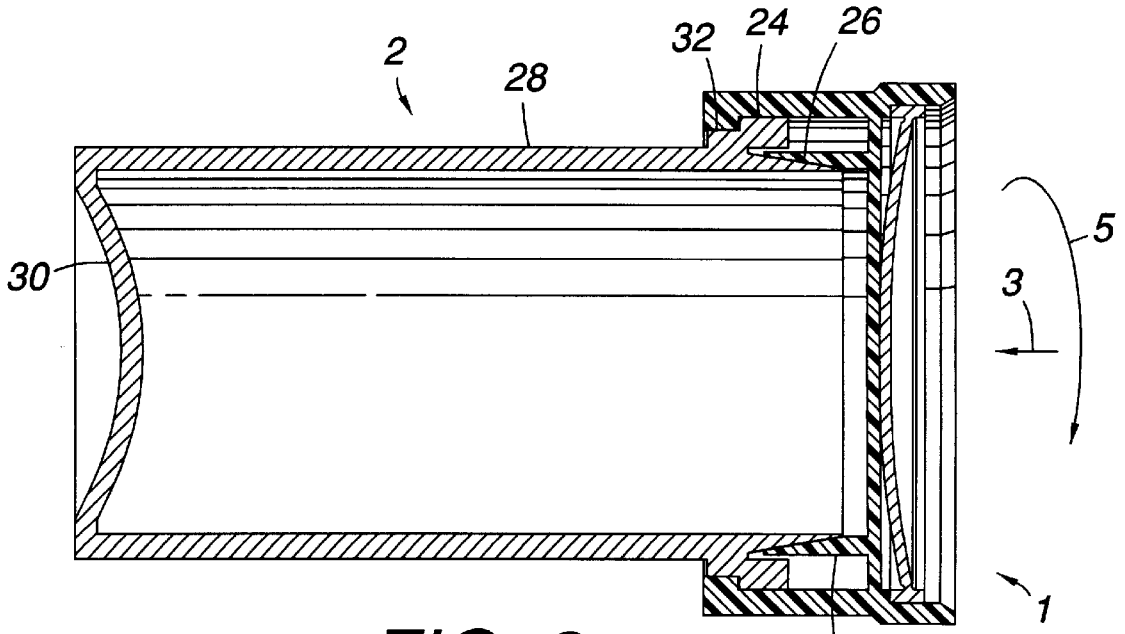
FIG. 2 is a cross-sectional view of the push-and-turn closure as shown in FIG. 1B, with the closure engaged to the opening of a container.

Referring now to FIG. 2, the closure 1 is shown in second mode engagement with container 2, comprising tube 28, base 30, closure taper 6, and bayonet teeth 24. Container taper 26 makes contact with closure taper 6 to seal the interior of the container 2. Bayonet teeth 24 integral with the container 2 engage with tabs 18 of the closure 1, so that pressure must be applied to the closure 1 in direction 3, followed by a twisting action in direction 5, in order to decouple the bayonet teeth 24 from the integral tabs 18 of the closure 1. Pressure in the direction 3 is resisted in part by the curved disk 12 in pressure contact with the top 10.

In FIG. 3, the closure 1 in second mode engagement with container 2 is shown in a partial cut-away view to show detail of the bayonet tooth 24. The tooth 24 comprises ramp 34 and land 36. The upper surface of tab 18 of the closure 1 rests against land 36, and cannot escape unless pressure is applied to the closure in direction 3, while the closure is twisted in direction 5 relative to container 2. The geometry of the tooth 24 is a non-exclusive example of engagement means that may be used with the instant invention, and any tooth geometry or other means that allows the closure to decouple from the container by pressing and then turning of the closure relative to the container may be used.

In FIG. 4, the closure of FIG. 3 is shown in direction 3. The central area of contact of the curved disk 12 with the underlying top is shown as the area 40. If the curved disk 12 is translucent, area 40 on the top 10 (FIG. 3) will be revealed by contact pressure, and will be hidden when the curved disk 12 is curved upwards so that it is not in contact with the top. The area 40 may be used to further indicate that the closure is in the second (child-resistant) mode. In FIG. 4, area 40 is in the form a solid color. Symbols such as a lock icon, or text such as "PRESS AND TURN", may be substituted for the solid color shown, as desired.

Turning now to FIG. 5, a closure according to an alternative embodiment of the instant invention is generally indicated by numeral 100. The bi-stable curved disk 50 is integral with the upper ring 54, while the closure taper 52 is part of the separate taper insert, indicated generally by numeral 56. The taper insert 56 is somewhat compliant, and deflects vertically along the vertical axis of the clsoure relative to the upper ring 54 and the rest of the closure 100, when downward vertical force is applied to the upper ring 54. The taper insert 56 also comprises top 44, and reversible section 46 with tab 48, by which the user may return the closure 100 from the first mode to the second mode by applying finger pressure to the lower surface of the reversible section 46.

Figure 6A:
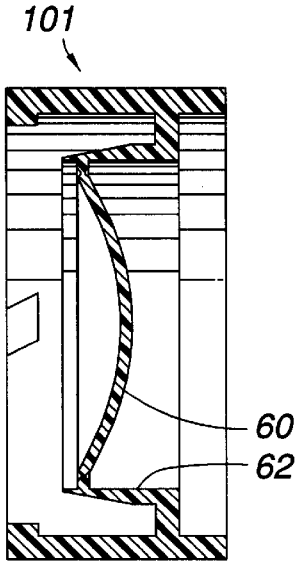
FIG. 6A is a cross-sectional view of a push-and-turn closure according to one embodiment of the invention, showing an alternative unitary construction of the bi-stable disk.
Figure 6B:
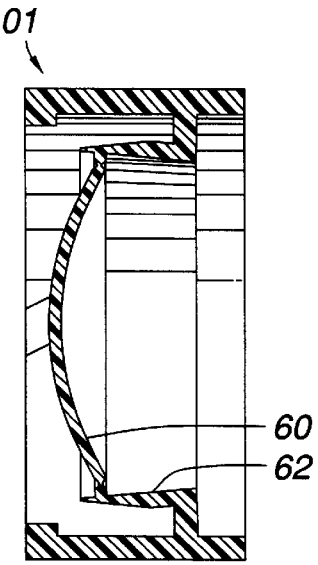
FIG. 6B is a cross-sectional view of a push-and-turn closure of FIG. 6A, shown in the second mode.

In FIG. 6A, an alternative embodiment of a one-piece closure generally indicated by numeral 101 is shown in the first mode. Curved disk 60 is integral with closure taper 62. The position of the curved disk 60 near the tip of the closure taper 62 tends to resist inward deformation of the taper when engaged to a container. In FIG. 6B, the curved disk 60 is shown inverted. If the curved disk 60 is molded in the first mode, it will tend to invert to a shallower curvature in the second mode, and therefore will tend to spread out the closure taper 62, effectively resulting in a greater spring rate of the taper, and will therefore require more downward pressure to achieve the proximal orientation with an engaged opening in the second mode as compared to the first mode.

Figure 7:
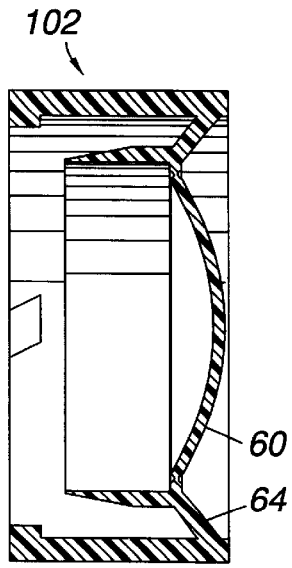
FIG. 7 is a cross-sectional view of a push-and-turn closure according to one embodiment of the invention, showing an alternative placement of the bi-stable disk.

In FIG. 7, another alternative placement of the curved disk 60 is shown in the closure generally indicated by numeral 102. In this embodiment, reversal of the curved disk tends to spread the conic ring 64 which supports closure taper 62, thereby tending to move the closure taper towards the lower part of the closure 102, and increasing the effective spring rate when engaged with a container.

Figure 8A:
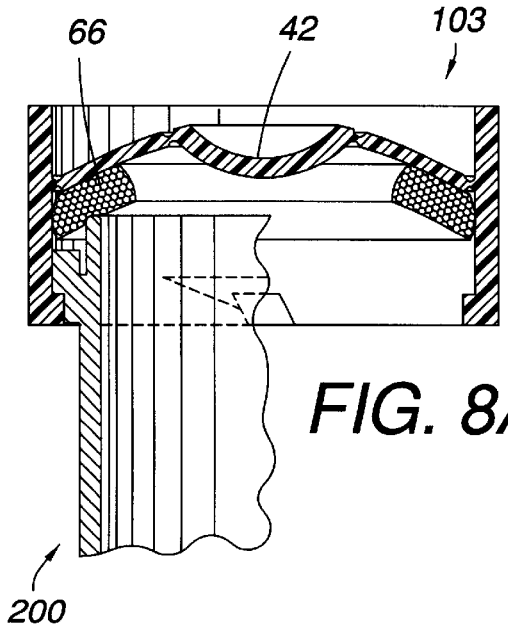
FIG. 8A is a partial cross-sectional view of a push-and-turn closure engaged to a container, according to one embodiment of the invention, with the closure in the first mode.
Figure 8B:
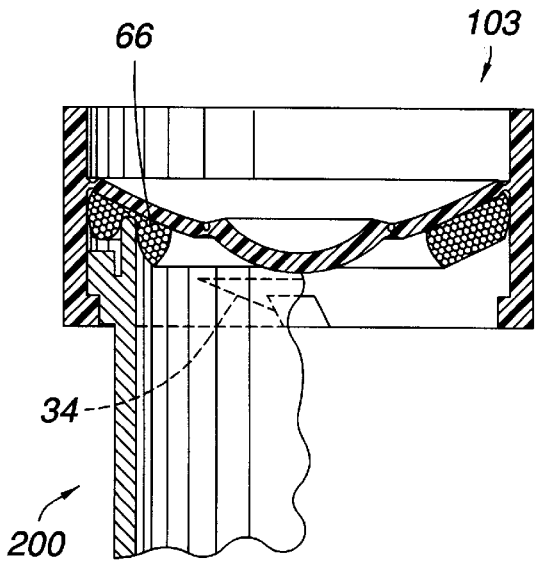
FIG. 8B is a partial cross-sectional view of a push-and-turn closure engaged to a container, as shown in FIG. 8A, with the closure in the second mode.

Turning now to FIG. 8A, a reversible closure according to an alternative embodiment of the instant invention is generally indicated by numeral 103, which is shown in first mode engagement with container 200. Container 200 is shown in partial section to illustrate the deformation of compliant seal 66, which is shown on the left side to deform against the upper edge of container 200 to effect a seal in the first mode. In FIG. 8B, the closure 103 is shown in the second mode, with the compliant seal 66 under greater deformation, thereby increasing the force necessary to decouple the closure from the container. The compliant seal 66 may be formed of soft rubber, with foam rubber preferred. It is most preferred that the outside surface of the compliant seal have a continuous skin, so as to best exclude water vapor and oxygen from the interior of the container 200.

Figure 9A:
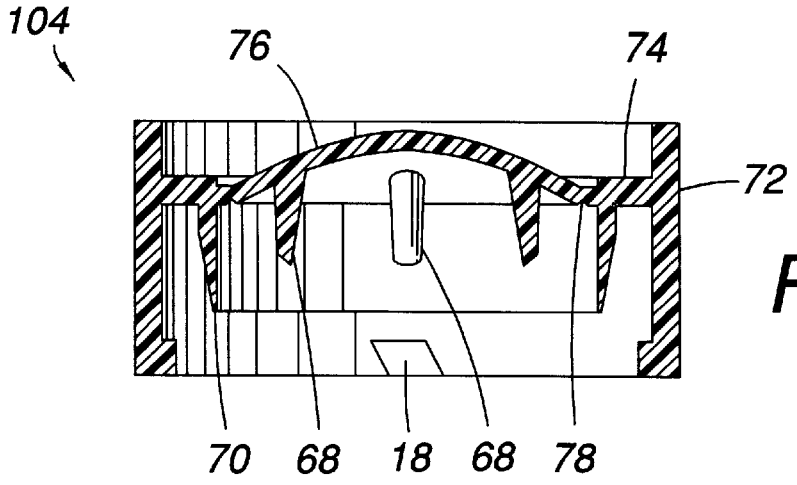
FIG. 9A is a cross-sectional view of a push-and-turn closure, according to one embodiment of the invention, with the closure in the first mode.
Figure 9B:
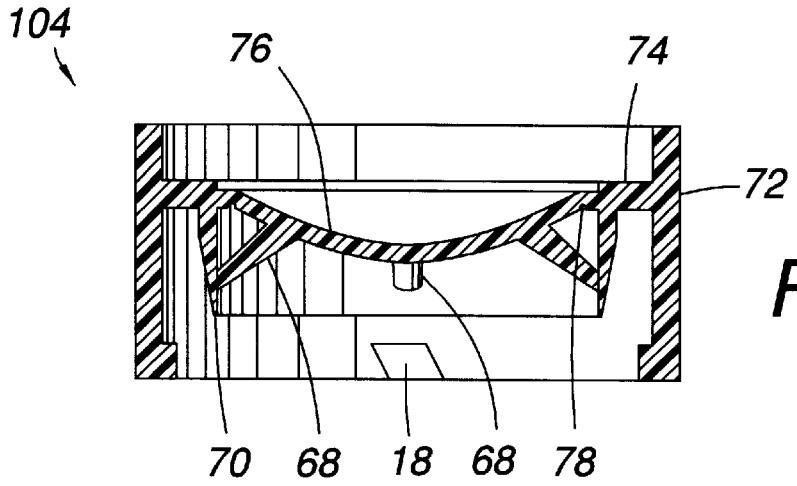
FIG. 9B is a cross-sectional view of a push-and-turn closure, according to one embodiment of the invention, with the closure in the second mode.
Figure 10:
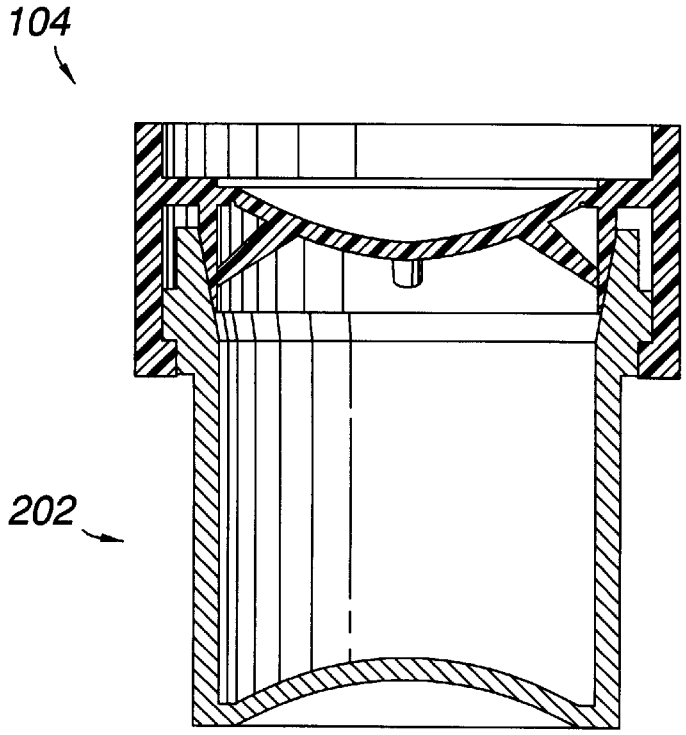
FIG. 10 is a cross-sectional view of a push-and-turn closure of FIG. 9B engaged to a container.

FIGS. 9A and 9B illustrate an alternative embodiment of the instant invention, wherein the reversible closure is generally indicated by the numeral 104. In FIG. 9A, the closure is shown in the first mode, with bi-stable disk 76 curved upwards. At stress relief 78, disk 76 is joined to top 74, and thence to top 74, which is in turn supported by ring 72. Top 74 also serves as support for closure taper 70. Projecting from the lower surface of disk 76 are a plurality of fingers 68. In FIG. 9B, the closure 104 is shown in a disengaged second mode, wherein the disk 76 is inverted, allowing fingers 68 to contact the inner surface of closure taper 70, thereby stiffening the taper and increasing the force needed to remove the closure from the container 202 (as shown engaged in FIG. 10).

In the embodiments described in FIGS. 1–10, the closures have all been of the partial turn type, that is, a twist of less than 360 degrees divided by the number of teeth is required to effect full closure (or opening). In FIGS. 11–12, another embodiment is shown wherein more than one half turn is typically required (depending upon the pitch of the teeth). In FIGS. 11A and 11B, closure 105 in shown in the first mode, wherein the drive ring 82 is in a distal orientation relative to the rest of the closure. The cap 86 has threads 88 for engaging a container. In the first mode, flaps 98 serve to space the drive ring 82 from the cap 86, thereby separating the drive teeth 92, attached to the lower surface of the drive ring, from the driven teeth 94, attached to the upper surface of the cap 86. The flaps 98 are optional, and are intended only to supply a sufficient force to keep the cap 86 in a distal orientation to the opening of an engaged container.

In FIG. 11B, the closure 105 is shown in the second mode, with the disk 80 in the inverted position. In this inverted position, the disk 80 acts as a spring to keep the drive ring 82 in the distal position, and thereby keeps the closure 105 in the second (child-resistant) mode, while projection 84 serves to prevent the drive ring 82 from being removed from the cap 86.

Turning now to FIG. 12A, the closure 105 is shown in the first (adult-use) mode, engaged to container 203. A slight pressure is applied to the upper surface of closure 105 to place the ring 105 in the proximal position, so that drive teeth 92 engage with driven teeth 94, whereby the cap may be twisted from the container 203. In FIG. 12B, the closure 105 is shown engaged with container 203 in a perspective view. Since the disk is convex, the user is informed that closure is in the adult-use mode.

In FIG. 13A, the closure 108 is shown in the first mode. Compliant element 113, preferably comprising an elastomeric or rubber foam, is situated between the disk 80 and the cup 96, where the element 113, if already slightly compressed, serves to supply sufficient force to keep the drive ring 82 in the distal position. In FIG. 13B, the closure 108 is shown in the second mode. Compliant element 113 is compressed between the disk 80 and the cup 96, where the element 113 serves to increase the spring rate to place the closure 108 in the second mode.

In the embodiments described in FIGS. 1–13, the closures have all embodied bi-stable disks. In FIGS. 14 and 15, a closure 106 is shown which employs a bi-stable spoked element 111 with three straight spokes 110 (although any plurality of spokes may be employed). The spokes 110 are supported by a triangular center 112, and an annular ring 114, which fits into the upper ring 14 of closure 106. Reversal of the spoked element (not shown) adds to the spring constant of the top 10 in the same way as the bi-stable disk previously described.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

I claim:

1. A container system selectable between adult-use and child-resistant modes, comprising:

a container comprising a volume and an opening, said opening comprising peripheral teeth;

a closure comprising an upper surface and a turning axis, said closure comprising engaging members adapted to engage said peripheral teeth;

said closure comprising at least a deflecting member deflectable along said turning axis, said deflecting member deflecting from a distal to a proximal orientation relative to said opening when said engaging members are engaged to said peripheral teeth, said deflecting member having a variable spring rate;

an invertible bi-stable spring element in said upper surface, said invertible bi-stable spring element having a substantially convex first stable orientation and a substantially concave second stable orientation, said first stable orientation having a first associated spring rate of said deflecting member, said second stable orientation having a second associated spring rate of said deflecting member;

wherein said second spring rate is greater than said first spring rate;

wherein said invertible bi-stable spring element may be converted from said first to said second stable orientation by finger pressure; and wherein said invertible bi-stable spring element is substantially nonconvertible by manual manipulation from said second to said first stable orientation when said engaging members are engaged to said peripheral teeth;

whereby the container system is in the adult-use mode when said invertible bi-stable spring element is in said first stable orientation, and is in the child-resistant mode when said bi-stable element is in said second stable orientation, and whereby the container system is substantially nonconvertible from the child-resistant mode when the closure is engaged to the opening.

2. A container system selectable between adult-use and child-resistant modes as recited in claim 1, wherein said invertible bi-stable spring element comprises a curved disk.

3. A container system selectable between adult-use and child-resistant modes as recited in claim 2, wherein said curved disk has a circular periphery.

4. A container system selectable between adult-use and child-resistant modes as recited in claim 1, wherein said invertible bi-stable spring element is unitary with said deflecting member.

5. A container system selectable between adult-use and child-resistant modes, as recited in claim 1, wherein said first associated spring rate is non-zero, and said second associated spring rate is at least 25 percent greater than said first associated spring rate.

6. A container system selectable between adult-use and child-resistant modes, as recited in claim 1, wherein said first associated spring rate is non-zero, and said second associated spring rate is at least 50 percent greater than said first associated spring rate.

7. A container system selectable between adult-use and child-resistant modes, as recited in claim 1, wherein said first associated spring rate is non-zero, and said second associated spring rate is at least twice said first associated spring rate.

8. A container system selectable between adult-use and child-resistant modes, as recited in claim 1, wherein said first associated spring rate is zero, and said second associated spring rate is at least one pound per inch.

9. A container system selectable between adult-use and child-resistant modes, as recited in claim 1, wherein said peripheral teeth are bayonet teeth.

10. A container system selectable between adult-use and child-resistant modes, as recited in claim 1, wherein said invertible bi-stable spring element in said second stable orientation comprises a lower surface, whereby said invertible bi-stable spring element can be returned to said first stable orientation by finger pressure when said closure is removed from said opening.

11. A container system selectable between adult-use and child-resistant modes, as recited in claim 1, further comprising:

a non-deflecting member comprising an upper surface, said upper surface comprising driven teeth thereon, wherein said non-deflecting member comprises an axis coincident with said turning axis and wherein said engaging members are fixed to said non-deflecting member; and wherein said deflecting member comprises a lower surface comprising drive teeth, wherein said drive teeth are engageable with said driven teeth when said deflectable member is deflected into said proximal orientation with said opening, and wherein said drive teeth are not engageable with said driven teeth when said deflecting member is deflected into said distal orientation with said opening.

12. A container system selectable between adult-use and child-resistant modes, as recited in claim 11, further comprising a spring member disposed between said deflecting member and said non-deflecting member, said spring member urging said deflecting member into said distal position.

13. A container system selectable between adult-use and child-resistant modes, as recited in claim 11, wherein said invertible bi-stable spring element comprises a curved disk.

14. A container system selectable between adult-use and child-resistant modes, as recited in claim 13, wherein said curved disk is comprised of a translucent polymer or elastomer.

15. A container system selectable between adult-use and child-resistant modes, as recited in claim 14, wherein said non-deflecting member comprises a surface oriented beneath said curved disk, said surface comprising a color area and/or symbol printed thereupon, whereby proximity of said curved disk with said top surface in said second stable mode reveals said color area and/or said symbol.

16. A container system selectable between adult-use and child-resistant modes, as recited in claim 11, wherein said volume comprises a pharmaceutical agent.

17. A container system selectable between adult-use and child-resistant modes, as recited in claim 11, wherein said invertible bi-stable spring element in said second stable orientation comprises a lower surface, whereby said invertible bi-stable spring element can be returned to said first stable orientation by pressure when said closure is removed from said opening.

18. A container system selectable between adult-use and child-resistant modes as recited in claim 1, wherein said opening comprises an internal taper having a taper axis coincident with said turning axis; and wherein said first deflecting member comprises an external taper, wherein said external taper inserts into said internal taper when said closure is engaged to said opening.

19. A container system selectable between adult-use and child-resistant modes as recited in claim 18, wherein said invertible bi-stable spring expands said external taper when said invertible bi-stable spring is inverted from said first orientation into said second orientation.

20. A container system selectable between adult-use and child-resistant modes as recited in claim 19, wherein:

said external taper comprises a cylinder with an interior wall; and said invertible bi-stable spring element comprises a lower surface having projecting fingers therefrom, wherein said projecting fingers press against said interior wall when said invertible bi-stable spring element is inverted into said second stable orientation.

21. A container system selectable between adult-use and child-resistant modes as recited in claim 1, wherein said opening comprises an external taper;

wherein said deflecting member comprises an internal taper; and wherein said external taper inserts into internal taper when said closure is engaged to said opening.

22. A container system selectable between adult-use and child-resistant modes as recited in claim 21, wherein said invertible bi-stable spring element comprises a curved disk.

23. A container system selectable between adult-use and child-resistant modes as recited in claim 21, wherein said invertible bi-stable spring element comprises spokes.

24. A container system selectable between adult-use and child-resistant modes as recited in claim 1, wherein said opening comprises a rim having an axis coincident with said turning axis; and wherein said invertible bi-stable spring member comprises a lower surface, said lower surface comprising a spring member fixed thereupon, whereby said spring element is compressed against said rim when said invertible bi-stable spring element is inverted from said first stable orientation into said second stable orientation.

25. A container system selectable between adult-use and child-resistant modes as recited in claim 24, wherein said spring member comprises a foamed elastomer, rubber, or polymer.

26. A container system selectable between adult-use and child-resistant modes as recited in claim 24, wherein said invertible bi-stable spring element comprises a curved disk.

27. A convertible child-resistant closure for a container having an opening, comprising:

a first closure member having a turning axis, said first closure member engageable to said opening;

a second closure member having an upper surface, said second closure member moveable relative to said first closure member along said turning axis, said second closure member having a distal relationship to said first closure member when said first closure member is engaged to the opening, wherein said first closure member is substantially non-removable from the opening, and a proximal relationship to said first closure member wherein said first closure member may be removed from the opening by turning said second closure member on said axis; and an invertible bi-stable spring element located within said upper surface of said second closure member, said invertible bi-stable spring element having a first stable position and a second stable position, wherein in said second stable position, said invertible bi-stable spring element is inverted relative to said first stable position, and wherein in said second stable position, said invertible bi-stable spring element urges said second closure member into said distal position.

28. A convertible child-resistant closure for a container having an opening, as recited in claim 27, further comprising a spring member disposed between said first closure member and said second closure member, said spring member urging said second closure member into said distal position.

29. A convertible child-resistant closure for a container having an opening, as recited in claim 28, said spring member comprising flexible flaps.

30. A convertible child-resistant closure for a container having an opening, as recited in claim 28 said spring member comprising compliant elastomeric or polymeric foam.

31. A convertible child-resistant closure for a container having an opening, as recited in claim 27, further comprising first teeth located on said first closure member, and second teeth located on said second closure member, said first teeth engageable with said second teeth when said second closure member is in said proximal relationship to said first closure member, whereby said second closure member may apply a torque on said first closure member.

32. A convertible child-resistant closure for a container having an opening, as recited in claim 27, wherein said invertible bi-stable spring element comprises a curved disk.

33. A convertible child-resistant closure for a container having an opening, as recited in claim 31, wherein said invertible bi-stable spring element comprises a curved disk.

34. A convertible child-resistant closure for a container having an opening, as recited in claim 27, wherein said invertible bi-stable spring element is comprised of a polymer, elastomer, or metal.

35. A convertible child-resistant closure for a container having an opening, as recited in claim 33, wherein said curved disk is comprised of a translucent polymer or elastomer.

36. A convertible child-resistant closure for a container having an opening, as recited in claim 35, wherein said first closure member further comprises a surface orientated directly beneath said curved disk, said surface comprising a color area and/or symbol printed thereupon, whereby contact of said curved disk with said top surface in moving into said second stable mode reveals said color area and/or said symbol.

37. A convertible child-resistant closure for a container having an opening, as recited in claim 27, further comprising a container threadably engaged to the closure at the opening.

38. A convertible child-resistant closure for a container having an opening, as recited in claim 37, wherein said container comprises a pharmaceutical agent therein.

39. A convertible child-resistant closure for a container having an opening, as recited in claim 27, wherein said first closure member comprises a reversible portion, whereby pressing said reversible portion converts said invertible bi-stable element into said first stable position from said second stable position.

* * * * *